US008304157B2

(12) United States Patent
Kouyama et al.

(10) Patent No.: US 8,304,157 B2
(45) Date of Patent: Nov. 6, 2012

(54) TONER AND MANUFACTURING METHOD THEREOF

(75) Inventors: Mikio Kouyama, Tokyo (JP); Ken Ohmura, Tokyo (JP); Kenji Hayashi, Tokyo (JP); Yukio Hosoya, Tokyo (JP); Hiroaki Obata, Tokyo (JP); Koji Shibata, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 238 days.

(21) Appl. No.: 12/797,720

(22) Filed: Jun. 10, 2010

(65) Prior Publication Data

US 2010/0323290 A1 Dec. 23, 2010

(30) Foreign Application Priority Data

Jun. 18, 2009 (JP) ..... 2009-145345

(51) Int. Cl.
*G03G 9/08* (2006.01)

(52) U.S. Cl. ..... 430/109.5; 430/108.22; 430/137.15; 526/263

(58) Field of Classification Search ..... 430/109.5, 430/108.22, 137.15; 526/263
See application file for complete search history.

(56) References Cited

U.S. PATENT DOCUMENTS

| | | | | |
|---|---|---|---|---|
| 4,254,201 | A | 3/1981 | Sawai et al. | |
| 2007/0207402 | A1 * | 9/2007 | Takagi et al. | 430/110.2 |

FOREIGN PATENT DOCUMENTS

| | | |
|---|---|---|
| JP | 63-216063 | 9/1988 |
| JP | 8-3665 | 1/1996 |

OTHER PUBLICATIONS

Iwamura, et al: A Novel De-Cross-Linking System from Cross-Linked Polymer to Linear Polymer Utilizing Pressure or Visible Light Irradiation Macromolecules, vol. 41, Nov. 11, 2008, pp. 8995-8999, XP002599740 DOI: 10.1021/ma801298e *p. 8995-p. 8999 *.

* cited by examiner

*Primary Examiner* — Mark A Chapman
(74) *Attorney, Agent, or Firm* — Lucas & Mercanti, LLP

(57) ABSTRACT

A toner for an electrophotography and its manufacturing method are disclosed. The toner comprises toner particles containing a cross-linked polymer having two-valent crosslinking group represented by Formula (1),

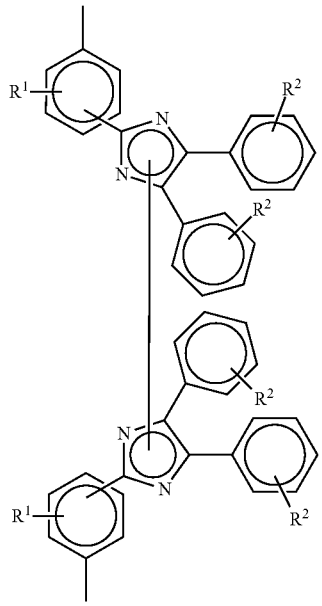

wherein, $R^1$ is a hydrogen atom or a chlorine atom, $R^2$ is a hydrogen atom, a chlorine atom or a methoxy group. The toner satisfies storage durability against heat as well as sufficient low temperature fixing ability.

9 Claims, No Drawings

TONER AND MANUFACTURING METHOD THEREOF

This application is based on Japanese Patent Application No. 2009-145345 filed on Jun. 18, 2009, in Japanese Patent Office, the entire content of which is hereby incorporated by reference.

TECHNICAL FIELD

The present invention relates to a toner and its manufacturing method.

BACKGROUND

Recently saving energy is considered in various fields in view of preventing global warming. Progress has been made in the energy saving such as less power during stand-by time, and consideration of the low temperature fixing of the fixing process consuming most energy in the information apparatus such as an image forming apparatus.

There is a problem that the toner must be composed of a resin having high glass transition temperature to obtain storage durability against heat in the toner having basic structure and therefore the fixing temperature is inevitably high, fundamentally. Consequently the storage durability against heat and low temperature fixing ability are in a trade-off relation and it is difficult to compatibly attain.

A toner is proposed which contains cross-linking a resin obtained by bonding a polymer containing carboxylic acid component and a multi-valent metal compound for a toner of the electrophotographic image forming apparatus to realize low temperature fixing, as disclosed in, for example, JP-B H08-003665. Low temperature fixing ability and storage durability against heat can be obtained compatibly since melt viscosity of the resin lowers due to cleavage of bond relating to cross-liking by heating at thermal fixing process.

However, fixing temperature requires at lowest 150° C., and therefore sufficient low temperature fixing cannot be obtained by employing the proposed resin.

SUMMARY OF THE INVENTION

An object of this invention is to provide a toner capable of obtaining storage durability against heat as well as sufficient low temperature fixing ability and its manufacturing method.

The toner comprises toner particles containing a cross-linked polymer having two-valent crosslinking group represented by Formula (1).

Formula (1)

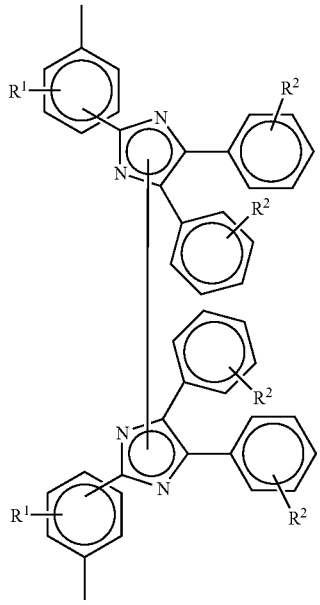

In the Formula (1), $R^1$ is a hydrogen atom or a chlorine atom, $R^2$ is a hydrogen atom, a chlorine atom or a methoxy group.

It is preferable that the cross-linked polymer has a structural unit represented by Formula (2).

Formula (2)

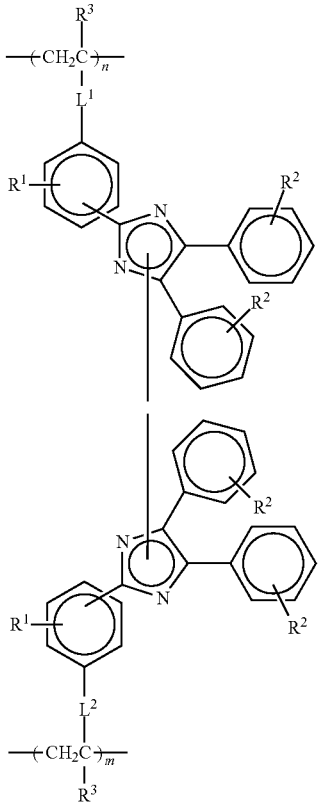

In the Formula (2), $R^1$ is a hydrogen atom or a chlorine atom, $R^2$ is a hydrogen atom, a chlorine atom or a methoxy group, $R^3$ is a hydrogen atom or a methyl group, $L^1$ and $L^2$ each are a single bond or a divalent organic group, and $L^1$ and $L^2$ may be same or different each other. m and n are number of recurring units.

It is possible that the toner comprises toner particles having a core shell structure in which each of the toner particles is composed of a core particle and a shell layer covering the core particle and the shell layer contains the cross-linked polymer.

It is preferable that the core particle contains a resin having a glass transition point of 10 to 46° C. in this toner.

The above mentioned toner is manufactured by a manufacturing method of the toner employing a polymerizable triaryl imidazole compound represented by Formula (3), wherein the method comprises steps of preparing a dimer of the polymerizable triaryl imidazole compound represented by Formula (4) by bonding between imidazole rings of the triaryl imidazole groups, and then, preparing the cross-linked polymer by conducting polymerization processing the dimer of the polymerizable triaryl imidazole compound.

Formula (3)

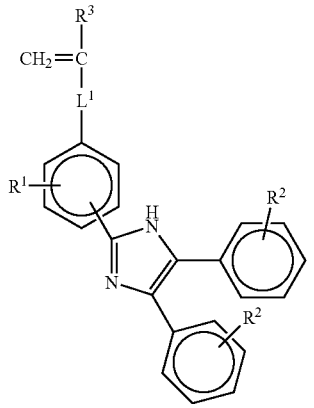

In the Formula (3), $R^1$ is a hydrogen atom or a chlorine atom, $R^2$ is a hydrogen atom, a chlorine atom or a methoxy group, $R^3$ is a hydrogen atom or a methyl group, $L^1$ is a single bond or a two-valent organic group.

Formula (4)

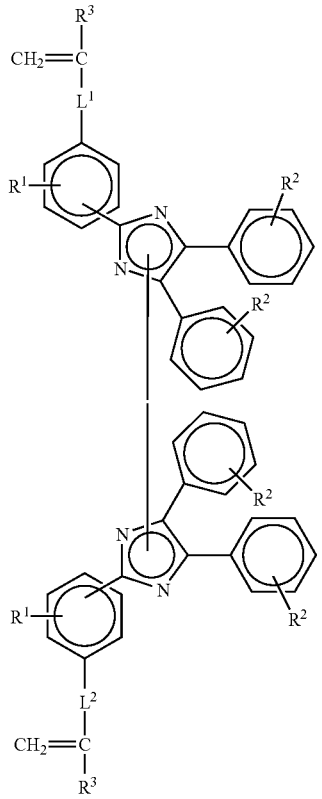

In the Formula (4), $R^1$ is a hydrogen atom or a chlorine atom, $R^2$ is a hydrogen atom, a chlorine atom or a methoxy group, $R^3$ is a hydrogen atom or a methyl group, $L^1$ and $L^2$ are each a single bond or a two-valent organic group, and $L^1$ and $L^2$ may be same or different each other.

It is preferable in the manufacturing method of the toner that the polymerization process is conducted in a state that polymerization liquid obtained by dissolving or dispersing a dimer of the polymerizable triaryl imidazole compound in a copolymerizable monomer to be copolymerized with the dimer of the polymerizable triaryl imidazole compound or an organic solvent.

The above mentioned toner is manufactured by a manufacturing method of the toner comprising steps of preparing a prepolymer containing a triarylimidazole group having a structural unit represented by Formula (5) by conducting polymerization processing a polymerizable triaryl imidazole compound represented by Formula (3) and then, preparing the cross-linked polymer by bonding between imidazole rings of the triaryl imidazole groups.

Formula (3)

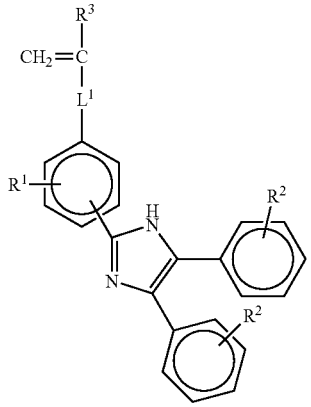

In the Formula (3), $R^1$ is a hydrogen atom or a chlorine atom, $R^2$ is a hydrogen atom, a chlorine atom or a methoxy group, $R^3$ is a hydrogen atom or a methyl group, $L^1$ is a single bond or a two-valent organic group.

Formula (5)

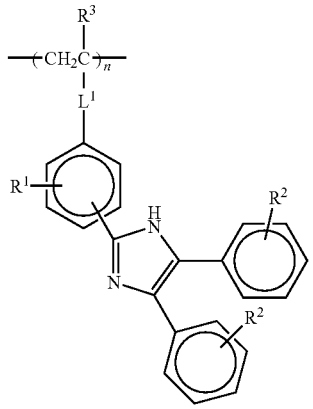

In the Formula (5), $R^1$ is a hydrogen atom or a chlorine atom, $R^2$ is a hydrogen atom, a chlorine atom or a methoxy group, $R^3$ is a hydrogen atom or a methyl group, is a single bond or a two-valent organic group, and n is a number of recurring units.

It is preferable in this manufacturing method that the polymerization process is conducted in a state that polymerization liquid containing the polymerizable triaryl imidazole compound is dispersed in an aqueous medium.

According to the toner of this invention, sufficient low temperature fixing ability is obtained while storage durability against heat is obtained, and further particle strength is exhibited so that the toner particles are not crushed in case of subjecting stress by strong stirring and so on.

The inventors estimate that at least the following action works;

The toner particles of this invention contain a specific cross-linked polymer, and the cross-linked polymer has a property the bond between imidazole rings cleaves by taking pressure. A molecular weight of the specific cross-linked polymer naturally lowers by the cleavage. The molecular lowering occurs by a pressure via fixing device, and glass transition point and melting characteristic curve of the toner shift to low temperature side. Accordingly toner melt is accelerated despite of low temperature, and sufficient low temperature fixing ability is obtained as the result. On the other hand, storage durability against heat improves because micro-Brown motion is prohibited in the specific cross-linked polymer. Further, large particle strength against stress by stirring etc., is obtained despite of low fixing temperature since the toner particles are reinforced by crosslinking points.

DETAIL DESCRIPTION OF INVENTION

The invention is described more in detail.

The toner comprises toner particles containing a two-valent crosslinking group represented by Formula (1), which may be called the specific crosslinking group.

(Specific Crosslinking Group)

In the Formula (1), $R^1$ is a hydrogen atom, a chlorine atom or a methoxy group, and preferably a hydrogen atom. It is preferable that group $R^1$ is bonded to the phenyl group at a para position of an imidazole ring in case that $R^1$ in the specific crosslinking group is a chlorine atom.

In the Formula (1), $R^2$ is a hydrogen atom, a chlorine atom or a methoxy group, and preferably a hydrogen atom. $R^2$ may be bonded to the phenyl group at a meth, ortho or para position of an imidazole ring in case that $R^2$ in the specific crosslinking group is a chlorine atom. It is preferable that group $R^2$ is bonded to the phenyl group at an ortho position of an imidazole ring in case that $R^2$ in the specific crosslinking group is a methoxy group.

In the Formula (1), it is preferable that the imidazole ring in the specific crosslinking group is connected to the benzene ring giving connecting points at the end of the crosslinking group at meta position with respect to a polymer chain to be connected to the end of the specific crosslinking group.

(Cross-Linked Polymer)

Practically a cross-linked polymer crosslinked by the specific crosslinking group described above can contain a structural unit represented by Formula (2).

In the Formula (2) $L^1$ and $L^2$ are a single bond or a two-valent organic group, respectively and $L^1$ and $L^2$ are same or different each other.

Example of the two-valent organic group forming groups $L^1$ and $L^2$ includes —C(═O)—NH, —C(═O)O—, —NH(C═O)NH— and —NHC(═O)O—.

In the Formula (2) $R^3$ is a hydrogen atom or a methyl group.

In the Formula (2), m and n are number of recurring units, and practically are an integer of 1 to 100.

A molecular weight of the cross-linked polymer, at a peak molecular weight in a molecular weight distribution obtained by styrene conversion molecular weight measured via gel permeation chromatography (GPC) at a state that a bond between imidazole rings is cleaved by giving pressure, is preferably 3,500 to 20,000, and more preferably 10,000 to 20,000. The peak molecular weight is a molecular weight corresponding to elution time of a peak top in the molecular weight distribution. In case that there are plural molecular weight peaks, it means the molecular weight corresponding to elution time of the peak top having maximum peak area ratio.

Molecular weight determination via GPC is carried out as follows. Practically, using apparatus "HLC-8220" (produced by Tosoh Corp.) and column "TSK guard column+TSK gel Super HZM-M (three in series)" (produced by Tosoh Corp.), while the column temperature is kept at 40° C., telrahydrofuran (THF) serving as a carrier solvent is passed at a flow rate of 0.2 ml/minute, and a measurement sample (toner) is dissolved in the tetrahydrofuran so as for the concentration thereof to be 1 mg/ml under a dissolution condition wherein dissolution is carried out using an ultrasonic homogenizer at room temperature for 5 minutes. Then, a sample solution is obtained via treatment using a membrane filter of a 0.2 μm pore size, and 10 μl of this sample solution is injected into the above apparatus along with the carrier solvent for detection using a refractive index detector (RI detector). The molecular weight is determined by the molecular weight distribution of the detecting sample.

Treatment for cleaving crosslinking: Toner in an amount of 30 g at ordinary temperature is put into an automatic agate mortar "AMM-140D/KN3324014", manufactured by Tech-Jam Co., Ltd., and pressure is given for 10 minutes at a rotating condition of the automatic agate mortar of 100 rpm.

The glass transition point (Tg) of the cross-linked polymer is preferably 45 to 100° C., more preferably 50-65° C. When the cross-linked polymer has a glass transition point of not lower than 45° C., the toner having sufficient storage durability against heat is obtained. When the glass transition point is higher than 100° C., phenomena of lowering glass transition point does not progressed by cleavage of bond between imidazole rings due to given pressure and, as the result, it is possible not to obtain sufficient low temperature fixing ability.

Herein, the glass transition point of the polyester resin is determined using differential scanning calorimeter "DSC-7" (produced by Perkin Elmer, Inc.) and thermal analyzer controller "TAC7/DX" (produced by Perkin Elmer, Inc.). Specifically, 4.50 mg of the toner is sealed in aluminum pan "Kit No. 0219-0041", and placed in a "DSC-7" sample holder. An empty aluminum pan is used as the reference measurement. Determination is carried out under conditions of a measurement temperature of 0 to 200° C., a temperature increasing rate of 10° C./minute, and a temperature decreasing rate of 10° C./minute via a heating-cooling-heating temperature control. Data is collected at the second heating. The glass transition point (Tg) is represented as the intersection of the extension of the base line, prior to the initial rise of the first endothermic peak, with the tangent showing the maximum inclination between the initial rise of the first endothermic peak and the peak summit. Herein, temperature is kept at 200° C. for 5 minutes during temperature increase at the first heating.

Degree of crosslinking representing ratio of bond between imidazole rings of triaryl imidazole groups in the cross-linked polymer is preferably 1 to 20%, more preferably 2 to 8%, and particularly preferably around 5%. When the degree of crosslinking in cross-linked polymer is not more than 1%, it is difficult to display expected effect of this invention, practically, sufficient storage durability against heat and particle strength cannot be obtained, and in case of 20% or more, it is possible that sufficient low temperature fixing ability cannot be obtained.

Degree of crosslinking in the cross-linked polymer can be controlled by selecting mixing ratio of the polymerizable triaryl imidazole compounds, that is, ratio of monomers in the copolymer.

The obtained cross-linked polymer can be used as a binder of the toner particles, and other resin can be used in combination with the cross-linked polymer to prepare the binder resin. It is preferable that a content ratio of the cross-linked polymer is not less than 20% in the binder resin to form the toner particles.

The toner particles composing a toner may contain a colorant, charge control agent, magnetic powder a releasing agent and so on if desired.

(Colorant)

Inorganic or organic colorants are usable for the toner. Specific colorants are as follows.

Black colorants such as carbon black, magnetic material and iron-titanium composite oxide black can be used, and examples of the carbon black include Channel Black, Furnace Black, Acetylene Black, Thermal Black and Lamp Black, and magnetic material includes magnetite and ferrite.

Yellow colorants include yellow dye such as C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112 and C.I. Solvent Yellow 162, and yellow pigment such as C.I. Pigment Yellow 12, C.I. Pigm17, C.I. Pigment Yellow 74, C.I. Pigment Yellow 93, C.I. Pigment Yellow 94, C.I. and Pigment Yellow 138, C.I. Pigment Yellow 155, C.I. Pigment Yellow 180 and C.I. Pigment Yellow 185 and mixture thereof.

Magenta colorants include magenta dye such as C.I. Solvent Red 2, C.I. Solvent Red 49, C.I. Solvent Red 52, C.I. Solvent Red 58, C.I. Solvent Red 63, C.I. Solvent Red 111 and C.I. Solvent Red 122, and magenta pigment such as C.I. Pigment Red 5, C.I. Pigment Red 48:1, C.I. Pigment Red 53:1, C.I. Pigment Red 57:1, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222, and mixture thereof.

Cyan colorants include cyan dye such as C.I. Solvent Blue 25, C.I. Solvent Blue 36, C.I. Solvent Blue 60, C.I. Solvent Blue 70, C.I. Solvent Blue 93 and C.I. Solvent Blue 95, and magenta pigment such as C.I. Pigment Blue 1, C.I. Pigment Blue 7, C.I. Pigment Blue 15, C.I. Pigment Blue 60, C.I. Pigment Blue 62, C.I. Pigment Blue 66 and C.I. Pigment Blue 76, and mixture thereof.

The foregoing colorants may be used alone or in combination. The colorant content is preferably from 1% to 30% by mass, and more preferably 2% to 20% by mass.

(Magnetic Powder)

Magnetic powder such as magnetite, γ-hematite, or various ferrite can be used when the toner particles contain magnetic powder. Content of the magnetic powder is preferably 10 to 500% by weight and more preferably 20 to 200% by weight in the toner particles.

(Charge Control Agent)

Toner particles may contain a charge control agent In this instance various type of materials giving positive or negative charge by frictional electrification as the charge control agent. Examples positive charge control agents include nigrosine dyes such as Nigrosine Base EX manufactured by Orient Chemical Industries Co., Ltd, quaternary ammonium salts such as QUATERNARY AMMONIUM SALT P-51 manufactured by Orient Chemical Industries Co., Ltd., alkoxylated amine, alkylamide, molybdenum acid chelate pigment, and imidazole compound such as PLZ1001 manufactured by SHIKOKU CHEMICALS CORPORATION. Examples negative charge control agents include metal complex compound such as BONTRON S-22 manufactured by Orient Chemical Industries Co., Ltd., BONTRON S-34 manufactured by Orient Chemical Industries Co., Ltd. BONTRON E-81 manufactured by Orient Chemical Industries Co., Ltd., BONTRON E-84 manufactured by Orient Chemical Industries Co., Ltd., SPIRON BLACK TRH manufactured by Hodogaya Chemical Co., Ltd., thio indigo dyes, quaternary ammonium salts such as COPYCHARGE NX VP434 manufactured by Hoechst Japan, calixarene compounds such as BONTRON E-89, manufactured by Orient Chemical Industries Co., Ltd., boron compounds such as LR147 manufactured by Japan Carlit Co., Ltd., and fluorine compound such as magnesium fluoride and carbon fluoride. As a negative charge control agent, the following metal complex can be used further to those shown above; oxycarboxylic acid metal complex, dicarboxylic acid metal complex, amino acid metal complex, diketone metal complex, diamine metal complex, and azo group containing benzene-naphthalene derivative skeleton metal complex. Toner charge performance can be improved by incorporating a charge control agent in toner particles.

Content ratio of the charge control agent is preferably 0.01 to 30% by weight, and more preferably 0.1 to 10% by weight in the toner particles.

(Releasing Agent)

Toner particles may contain a releasing agent. In this instance various types of waxes may be used as the releasing agent. Examples of preferable wax include polyolefin type wax such as low molecular weight polypropylene, polyethylene, oxidation type polypropylene and polyethylene.

Content ratio of the releasing agent is preferably 0.1 to 30% by weight, and more preferably 1 to 10% by weight in the toner particles.

(Other Toner Resin)

Toner particles may be manufactured by an emulsion association method described later. Polymerizable monomers to obtain the other resins include a vinyl monomer, for example, styrene; methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl amino methacrylate and dimethyl aminoethyl methacrylate; acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins such as ethylene, propylene and isobutylene, acrylic acid or methacrylic acid derivatives such as acrylonitrile, methacrylonitrile, and acrylamide. These vinyl monomers can be used singly or two or more in combination.

It is preferable to employ a polymerizable monomer having an ionic dissociation group as a polymerizable monomer in combination. Examples of the polymerizable monomer having an ionic dissociation group include those having a substituent group as a composing group such as a carboxylic acid group, sulfonic acid group and a phosphonic acid group, and practically listed are acrylic acid, methacrylic acid, maleic acid, itaconic acid, cinnamic acid and fumaric acid.

(Manufacturing Method of Toner)

Manufacturing method of the toner containing the cross-linked polymer includes;

(I): the method comprises steps of preparing a dimer of the polymerizable triaryl imidazole compound represented by Formula (4) by bonding between imidazole rings of triaryl imidazole groups of a polymerizable triaryl imidazole compound represented by Formula (3), and then, polymerizing the dimer of the polymerizable triaryl imidazole compound to form the cross-linked polymer, or (II): preparing a prepolymer containing a triarylimidazole group having a structural unit represented by Formula (5) by conducting polymerization of a polymerizable triaryl imidazole compound represented by Formula (3) and then, bonding between imidazole rings of the triaryl groups to form the cross-linked polymer.

In the Formula (3), $R^1$ is a hydrogen atom or a chlorine atom, and preferably a hydrogen atom. In case that $R^1$ in the Formula (3) is a chlorine atom, $R^1$ preferably is bonded to a phenyl group at para position of the imidazole ring. The polymerizable triaryl imidazole compound having a chlorine atom at para position of the imidazole ring is easy to form a crosslinking bond between imidazole rings.

In the Formula (3), $R^1$ is a hydrogen atom or a chlorine atom, and preferably a hydrogen atom. $R^2$ may be bonded to the phenyl group at a meta, ortho or para position of an imidazole ring in case that $R^2$ in the specific crosslinking group is a chlorine atom. It is preferable that group $R^2$ is bonded to the phenyl group at an ortho position of an imidazole ring in case that $R^2$ in the specific crosslinking group is a methoxy group.

In the Formula (3), it is preferable that the imidazole ring is bonded to the phenyl group at a meta position with respect to the group $L^1$, since it is easy to form a crosslinking bond between imidazole rings in this instance.

In the Formula (3), $L^1$ is a single bond or a two-valent organic group. Examples of the two-valent organic group composing $L^1$ include —C(=O)—NH—, —C(=O)O—, —NH(C=O)NH— and —NHC(=O)O—.

In the Formula (3), $R^3$ is a hydrogen atom or a methyl group.

Examples of the polymerizable triaryl imidazole compound represented by Formula (3) include those represented by Formulae of (a) to (e).

Formula (a)

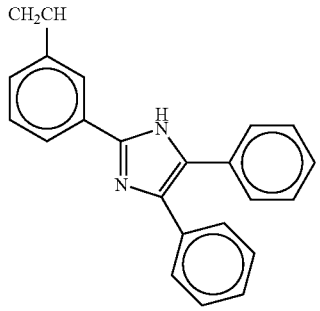

Formula (b)

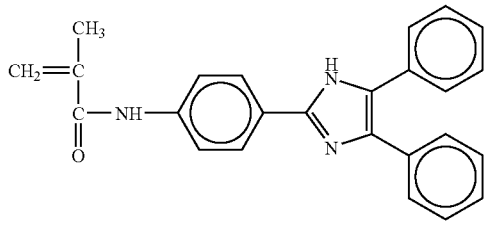

-continued

Formula (c)

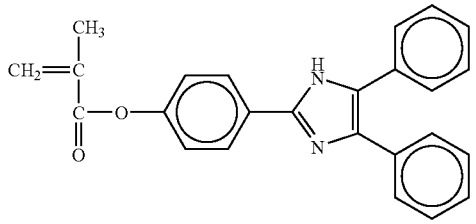

Formula (d)

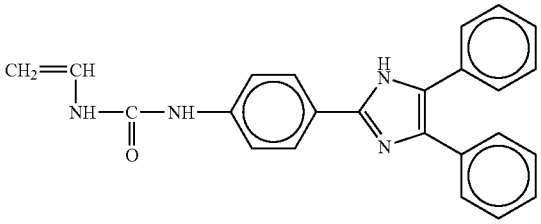

Formula (e)

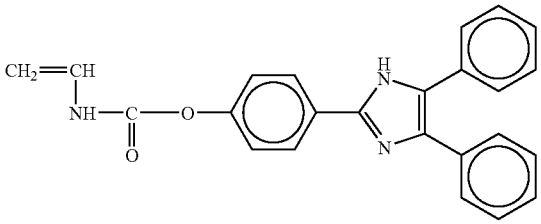

Manufacturing Method (I)

In the process (I) bonding treatment is conducted by adding an oxidizing agent to the polymerizable triaryl imidazole compound. Examples of the oxidizing agent include potassium ferricyanide, potassium permanganate, potassium chlorate, potassium bromate, and sodium bromate. Potassium ferricyanide is used preferably in particular among these. Treating temperature is 5 to 15° C., and treating time is 2 to 8 hours.

In Formula (4) $R^1$, $R^2$ and $R^3$ are the same as $R^1$, $R^2$ and $R^3$ in Formula (3), and in Formula (4) $L^1$ and $L^2$ are the same as $L^1$ in Formula (3).

The dimer of the polymerizable triaryl imidazole compound represented by Formula (4) are, for example, those represented by Formula (4-1), which is a dimer of the triaryl imidazole compound represented by Formula (a).

Formula (4-1)

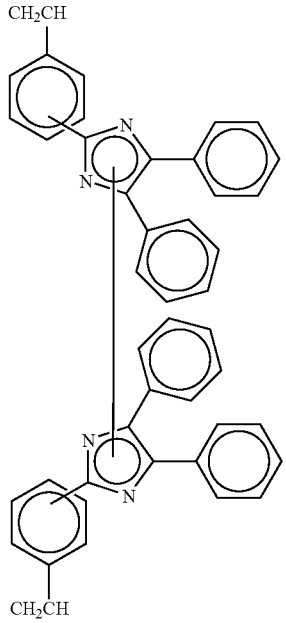

In the toner manufacturing method (I), it is preferable that the polymerization treatment is conducted in an aqueous medium, and a suspension polymerization method, an emulsion polymerization method or an emulsion association method can be used. Toner particles having sufficient crosslinking bonds without generating cleavage can be obtained by employing these methods. Cleavage of crosslinking bonds may occur by an external force such as kneading during manufacturing process in the so called pulverization method.

The polymerization treatment is practically conducted in a suspension or emulsion state in which polymerization liquid prepared by that a dimer of the polymerizable triaryl imidazole compound is dissolved or dispersed in a copolymerizable monomer to be copolymerized or an organic solvent is dispersed in an aqueous medium. Polymer particles obtained by the suspension polymerization or the emulsion polymerization can be used as the toner particles by themselves, and toner particles are obtained by association coagulation fusion treatment when the polymer particles are obtained by the emulsion-association method.

The "aqueous medium" refers to the medium prepared from 50% or more by weight of water. The water-soluble organic solvent other than water is exemplified by methanol, ethanol, isopropanol, butanol, acetone, methyl ethyl ketone, and tetrahydrofuran. The alcohol based organic solvent that does not dissolve resins, for example, methanol, ethanol, isopropanol, butanol are preferably used.

It is preferable to obtain the cross-linked polymer by copolymerizing a dimer of the polymerizable triaryl imidazole compound with copolymerizable monomers for copolymerization in the polymerization treatment. Examples of the monomers for copolymerization include acrylic acid, methacrylic acid, acrylate ester, methacrylate ester, and styrene, and particularly butylacrylate, 2-ethyhexyl acrylate are preferably employed.

The fixing property of the toner can be controlled by employing the cross-linked polymer synthesized by copolymerization of the monomers for copolymerization.

Copolymerization ratio of the dimer of the polymerizable triaryl imidazole compound to the monomers for copolymerization is preferably the dimer of the polymerizable triaryl imidazole compound: the monomers for copolymerization of 1:99 to 20:80 in molar ratio.

$R^1$, $R^2$ and $R^3$ in Formula (5) are the same as $R^1$, $R^2$ and $R^3$ in Formula (3). In case that $R^1$ in the triaryl imidazole group containing prepolymer represented by Formula (5) is chlorine atom, it is preferable that group $R^1$ is bonded at para position of the imidazole ring. It is easy to form a crosslinking bond between imidazole rings by the triaryl imidazole group containing prepolymer having $R^1$ at para position of the imidazole ring. In case that $R^2$ in the triaryl imidazole group containing prepolymer represented by Formula (5) is chlorine atom, group $R^2$ may be bonded at ortho, meta or para position of the imidazole ring. When $R^2$ is a methoxy group, it is preferable that group $R^2$ is bonded at ortho position of the imidazole ring.

In the Formula (5), it is preferable that the imidazole ring is bonded to the phenyl group at a meta position with respect to the group $L^1$, since it is easy to form a crosslinking bond between imidazole rings in this instance.

$L^1$ in Formula (5) is the same as $L^1$ in Formula (3). N is a number of recurring units, and practically is an integer of 1 to 100.

It is also preferable that the polymerization treatment is conducted in an aqueous medium, in the toner manufacturing method (II), and a suspension polymerization method, an emulsion polymerization method or an emulsion association method can be used. Toner particles having sufficient crosslinking bonds without generating cleavage can be obtained by employing these methods. Cleavage of crosslinking bonds may occur by an external force such as kneading during manufacturing process in the so called pulverization method.

The polymerization treatment is practically conducted in a suspension or emulsion state in which polymerization liquid containing the polymerizable triaryl imidazole compound is dispersed in an aqueous medium in the toner manufacturing method (II). Toner particles are obtained by subjecting the polymer particles to crosslinking treatment in case of employing the suspension polymerization or the emulsion polymerization, and by subjecting the obtained polymer particles to crosslinking treatment and then association coagulation fusion treatment in case of employing the emulsion-association method.

It is also preferable to obtain the cross-linked polymer by copolymerizing the polymerizable triaryl imidazole compound with copolymerizable monomers for copolymerization in the polymerization treatment in the toner manufacturing method (H). Example of the copolyrmerizable monomers for copolymerization is the same as those used in the toner manufacturing method (I).

The fixing property of the toner can be controlled by employing the cross-linked polymer synthesized by copolymerization of the monomers for copolymerization.

Copolymerization ratio of the polymerizable triaryl imidazole compound to the monomers for copolymerization is preferably the polymerizable triaryl imidazole compound: the monomers for copolymerization of 2:99 to 40:80 in molar ratio.

Crosslinking treatment in the toner manufacturing method (II) can be conducted by adding an oxidizing agent to triaryl imidazole group containing prepolymer. Examples of the oxidizing agent are the same as those used in the toner manufacturing method (I).

Treating temperature is preferably 5 to 15° C., and treating time is preferably 2 to 8 hours.

(Particle Diameter of Toner Particles)

The particle diameter of the toner particles composing the toner is preferably, for example, a volume median diameter of 4 to 10 μm and more preferably 6 to 9 μm. When the volume median diameter falls within the above range, transfer efficiency is increased, resulting in enhanced half-tone image quality as well as enhanced thin-line and dot image quality.

The volume median diameter of a toner is measured and calculated using a measurement device of "Coulter Multisizer TA-III" (produced by Beckman Coulter, Inc.) and a data processing computer system (produced by Beckman Coulter, Inc.) connected thereto. Specifically, 0.02 g of the toner is added in 20 ml of a surfactant solution (a surfactant solution prepared, for example, via ten-fold dilution of a neutral detergent containing a surfactant composition with purified water in order to disperse the toner), followed by being wetted and then subjected to ultrasonic dispersion for 1 minute to prepare a toner dispersion. The toner dispersion is injected into a beaker set on the sample stand, containing "ISOTON II" (produced by Beckman Coulter, Inc.), using a pipette until the concentration indicated by the measurement device reaches 5 to 10%. This concentration makes it possible to obtain reproducible measurement values. Then, a measured particle count number and an aperture diameter are adjusted to 25,000 and 50 μm, respectively, in the measurement device, and a frequency value is calculated by dividing a measurement range of 1-30 μm into 256 parts. The particle diameter at the 50% point from the higher side of the volume accumulation fraction is designated as the volume median diameter.

(Circularity of Toner Particles)

The toner particles composing toner is preferably an average value of circularity of 0.930 to 1.000, expressed by following Formula (T), and more preferably 0.950 to 0.995.

$$\text{Average value of circularity} = (\text{peripheral length of equivalent circle})/(\text{peripheral length of particle projected image}) \quad (T)$$

(External Additives)

The above described toner particles themselves can constitute the toner. However, to improve fluidity, chargeability, and cleaning properties, the toner particles may be added with an external additive, for example, a fluidizer which is so-called a post-treatment agent, or a cleaning aid, to form the toner of the present invention.

The post-treatment agent includes, for example, inorganic oxide microparticles such as silica microparticles, alumina microparticles, or titanium oxide microparticles; stearate microparticles such as aluminum stearate microparticles or zinc stearate microparticles; or inorganic titanate microparticles such as strontium titanate or zinc titanate. These can be used individually or in combination of at least 2 types.

These inorganic microparticles are preferably subjected to surface treatment with a silane coupling agent, a titanium coupling agent, a higher fatty acid, or silicone oil to enhance heat-resistant storage stability and environmental stability.

The total added amount of these various external additives is 0.05 to 5 parts by weight, preferably 0.1 to 3 parts by weight based on 100 parts by weight of the toner. Further, various appropriate external additives may be used in combination.

(Developer)

The toner may be used as a magnetic or non-magnetic single-component toner or a two-component toner by mixing with carriers. When the toner is used as a two-component toner, it is possible to use, as a carrier, magnetic particles including metals such as iron, ferrite, or magnetite, as well as alloys of the above metals with metals such as aluminum or lead, and ferrite particles are specifically preferable. Further, it is also possible to use, as the carrier, coated carriers in which the surface of magnetic particles is coated with a coating agent such as a resin; or binder-type carriers composed of magnetic fine powders dispersed in a binder resin.

A coating resin to form the coated carrier includes, for example, olefin resins, styrene resins, styrene-acryl resins, silicone resins, ester resins, and fluorine resins. Further, as a resin forming the resin-dispersion type carriers, various appropriate resin can be used including, for example, styrene-acryl resins, polyester resins, fluorine resins, and phenol resins.

The volume median diameter of the carriers is preferably 20 to 100 μm, and more preferably 20 to 60 μm. The volume median diameter of the carriers can be determined typically with laser diffraction type particle size distribution meter "HELOS" (produced by Sympatec Co.) equipped with a wet-type homogenizer.

The toner according to this invention is suitably employed in an image forming method including fixing process by a heat pressure fixing method in which heating along with pressure is applied. It is in particular suitably employed in the image forming method in which fixing is conducted at relatively low temperature fixing temperature such as surface temperature at fixing nip portion of the heating member of 80 to 110° C., preferably 80 to 95° C.

Further it is suitably employed in an image forming method with high speed fixing having fixing line speed of 5 to 600 mm/sec or more.

In the image forming method employing the toner of this invention a printed matter having a visible image thereon is practically obtained by steps of developing a static latent image formed on a photoreceptor to form a toner image, transfer the toner image to image carrying support, and then, fixing the transferred toner image on an image carrying support by a fixing process employing a heat pressure fixing method.

Applying pressure and heating are preferably conducted simultaneously, or it is possible that applying pressure is conducted first and then heating is applied, in the fixing process.

Pressure to be applied to toner particles composing a toner image transferred on an image carrying support is (1) 40 to 350 N in contact load between a heating roller and a pressure roller in a heat pressure roller type fixing device and (2) $9\times10^3$ to $5\times10^5$ N/m$^2$ in surface contact pressure of fixing film to the image carrying support in a film heating type fixing device, described later respectively.

Various types of fixing device may be used for a heat pressure fixing method in an image forming method employing the toner of this invention. A heat pressure roller type fixing device and a film heating type fixing device are described as examples of the thermal pressure fixing device.

(1) Heat Pressure Roller Type Fixing Device

The heat pressure roller type fixing device is composed of generally a pair of rollers including a heating roller and a pressure roller contacting with the heating roller, and fixing nip portion is formed due to deformation of the pressure roller by pressure applied between the heating roller and the pressure roller.

The heating roller is generally composed of a heat source such as a halogen lamp provided inside of core metal composed of a hollow metal roller such as aluminum. The core metal is heated by the heat source and the temperature is adjusted by controlling power for the heat source so that temperature of the outer surface of the heating roller is maintained as a predetermined fixing temperature. It is preferable that the heating roller is composed of core metal having large heat capacity and a rubber elastic layer covering the core metal to melt toner image uniformly when it is used as the fixing device in an image forming apparatus forming full color image, which requires that a toner image of toner layer comprising at maxima four layers be heat melt to mix colors sufficiently The pressure roller has an elastic layer composed of soft rubber such as urethane rubber and silicon rubber. The pressure roller contains a metal core composed of a hollow metal roller of, for example, aluminum, and it may have an elastic layer on its outer surface. The pressure roller may be composed of a heat source such as a halogen lamp provided inside of core metal similar to the heating roller and the core metal is heated by the heat source and the temperature is adjusted by controlling power for the heat source so that temperature of the outer surface of the pressure roller is maintained as a predetermined fixing temperature, when the pressure roller is composed to have a metal core.

It is preferable to employ the heating roller or pressure roller having a releasing layer formed with a fluorine resin such as polytetrafluoroethylene and polytetrafluoroethylene-perfluoroalkyl vinylether copolymer. Thickness of the releasing layer is around 10 to 30 μm.

An image carrying support to form a visible image is nipped and conveyed to fixing nip portion by rotating a pair of rollers, and unfixed toner image is fixed on the image carrying support by conducting heating with the heating roller and applying pressure at fixing nip portion in this heat pressure roller type fixing device.

(2) Film Heating Type Fixing Device

The film heating type fixing device is generally composed of a heating member such as a ceramic heater, a pressure roller and a fixing film composed of heat-resisting film is provided between the heating member and the pressure roller. The pressure roller deforms by a pressure given between the heating member and the pressure roller and a fixing nip portion is formed at the deformed portion.

As for the fixing film a heat-resisting film, sheet or belt composed of polyimide is employed. The fixing film may be composed of a substrate of the a heat-resisting film, sheet or belt composed of polyimide and a releasing layer formed with a fluorine resin such as polytetrafluoroethylene and polytetrafluoroethylene-perfluoroalkyl vinylether copolymer provided on the substrate. Further, it may have an elastic layer composed of, for example, a rubber between the film substrate and the releasing layer.

An image carrying support to form a visible image is nipped and conveyed to fixing nip portion between the fixing film and the pressure roller, and unfixed toner image is fixed on the image carrying support by conducting heating with the heating member and applying pressure at fixing nip portion in this film heating type fixing device. The heating member is allowed to be in a heated state up to predetermined fixing temperature by applying electric power to the heating member only image forming period, and obtain a quick start performance with short waiting time between a time switch on power of the image forming apparatus and a time capable of executing image forming, power consumption during standing by time of the image forming apparatus is extremely low and energy can be saved. Thus an advantage is obtained by employing the film heating type fixing device, Image Carrying Support An image carrying support used for the image forming method employing the toner of this invention includes a plain paper having various thickness, high quality paper, art paper, coated paper for printing Japanese paper, paper for a post card, a plastic film for OHP and cloth.

The toner of this invention contains cross-linked polymer, which has such a characteristics that the bond between imidazole rings of the triaryl imidazole group is cleaved subjected to pressure, and changes to one having lower glass transition temperature. Therefore, the toner becomes rapidly a state of lowered elastic coefficient sufficiently by applying pressure, even when the fixing temperature is low, and consequently sufficient low temperature fixing ability is obtained. On the other side, toner has good storage durability against heat because the cross-linked polymer according to this invention is restrained its micro-Brownian motion by heat at the state before applying pressure. Thus the toner of this invention has sufficient low temperature fixing ability while having storage durability against heat.

The toner of this invention has also high speed fixing ability, since the toner becomes rapidly a state of lowered elastic coefficient sufficiently by applying pressure.

Various changes may be applied to embodiments of the toner of this invention described above.

In an embodiment, the toner particles composing the toner have core shell structure composed of a core particle and a shell layer covering the surface of the core particle. The shell layer comprises the cross-linked polymer in the toner particles having a core shell structure. It is preferable that the shell layer covers completely the core particle in the toner particles having a core shell structure, and it is allowable that a part of core particle is exposed due to cracks in the shell layer and so on, as far as the component material of the core particle does not ooze outside. It is preferable that a charge control agent or magnetic powder is incorporated in the shell layer when they are employed. It is preferable that a colorant or a releasing agent is incorporated in the core particle, however it is possible to incorporate in the shell layer, when they are employed.

Core particle of the toner particles having a core shell structure may be composed of various kinds of resins, preferably for example, a resin containing styrene-acryl type resin.

The resin which is incorporated in the core particles includes those obtained by polymerizing the following vinyl monomers.

The vinyl monomer is listed, example, styrene; methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl amino methacrylate and dimethyl aminoethyl methacrylate; acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins such as ethylene, propylene and isobutylene, acrylic acid or methacrylic acid derivatives such as acrylonitrile, methacrylonitrile and acrylamide. These vinyl monomers can be used singly or two or more in combination.

It is preferable that the resin incorporated in the core particle has glass transition temperature of 10 to 46° C. Sufficient low temperature fixing property can be obtained by virtue of the toner comprising the core particle having the above mentioned glass transition temperature.

The glass transition temperature of the resin incorporated in the core particle can be measured by the same way as mentioned above wherein the resin incorporated in the core particle is used as the measuring sample.

The toner having the core shell structure is manufactured by, for example, a method wherein microparticles composed of material to form a shell layer in to the dispersion of core particles prepared by an optional method such as emulsion association method in an aqueous medium, and the microparticles for the shell layer are coagulated and fused on the surface of the core particles to form a shell layer covering the core surface.

EXAMPLES

The invention is explained by means of practical examples. The volume base median particle diameter, peak molecular weight and glass transition temperature were conducted in the same way as described before. The peak molecular weight and glass transition temperature measured for the toner as a sample are regarded as those of the cross-linked polymer.

[Synthesis Example of Vinyl-Triphenyl Imidazole Compound 1]

| | |
|---|---|
| Liquid mixture of Benzoin(2-hydroxyl,2-diphenyl ethanone) | 1,609 parts by weight |
| 3-vinylbenzaldehyde | 1,002 parts by weight |
| Ammonium acetate | 5,838 parts by weight |
| Boron tetrafluoride | 1,603 parts by weight |

was charged in a reaction vessel, heated up to 100° C., and stirring was continued for 1.5 hours. After completion of the reaction, the product was diluted with water, and the obtained solid was filtered and washed with water repeatedly, and dried. Then it was purified via silica gel chromatography employing a mixture solvent of hexane/ethylacetate (weight ratio of 9/1) and was recrystallized in a mixture solvent of methanol/dichloroethane (weight ratio of 9/1) to obtain vinyl-triphenyl imidazole compound (1), a compound represented by Formula (a).

Toner Manufacturing Example 1

Calcium tertiary phosphate in an amount of 2.3 parts by weight was added to 900 parts by weight of ion-exchanged water heated at 60° C., stirred at 10,000 rpm via TK type homomixer (manufactured by Tokushu Kika Kogyo Co., Ltd.) to prepare an aqueous medium. The following compounds

| | |
|---|---|
| Vinyl-triphenyl imidazole compound (1) | 10 parts by weight |
| n-Butyl acrylate | 30 parts by weight |
| Styrene | 60 parts by weight |
| Magenta colorant (C.I. Pigment Red 122) | 10 parts by weight |

were uniformly dispersed and mixed via an attritor mill (manufactured by Mitsui Miike Kakoki Co., Ltd.) and heated up to 60° C., 14 parts by weight of ester wax composing mainly behenyl behenate having maximum endothermic peak of 72° C., measured by DSC was added thereto and dissolved by mixing. Polymerizable monomer composition was prepared by dissolving 4 parts by weight of polymerization initiator lauroyl peroxide having 10 hour half-life temperature of 62° C. therein.

The polymerizable monomer composition was charged into the aqueous medium, and was agitated by TK type homomixer for 7 minutes at 10,000 rpm under nitrogen environment at 60° C., whereby particles were manufactured. Then reaction was continued for 6 hours at 60° C. while stirring by paddle stirring blade, then temperature was raised to 80° C., stirring was continued for 4 hours and suspension liquid was obtained. After the reaction was completed, the suspension liquid was cooled down to 10° C. at a ratio of −5° C.

After that 5 parts by weight of 1% potassium ferricyanide aqueous solution was added thereto, subjected to stirring for 1 minute at 10,000 rpm, then was subjected to reaction with stirring by paddle stirring blade for 6 hours at 10° C. Temperature was brought back to room temperature (25° C.), calcium phosphate was dissolved by adding hydrochloric acid, then they were filtered, washed and dried at 40° C. for 12 hours, and particle diameter was adjusted by air classification to obtain Toner Mother Particle (1).

Hundred parts by weight of the Toner Mother Particle (1), 0.7 parts by weight of hydrophobic silica microparticles having BET value of 200 $m^2/g$ and primary particle diameter of 12 nm, and 0.05 parts by weight rutile type titanium oxide having primary particle diameter of 250 nm were mixed by Henschel mixer manufactured by Mitsui Miike Kakoki Co., Ltd., and the Toner (1) was obtained. Volume base median particle diameter of Toner (1) was 6.8 μm. Cross-linked polymer (1) was detected from Toner (1). The glass transition point was 54.8° C., and peak molecular weight measured via GPC was 15,000 in Toner (1).

Cross-linked polymer (1)

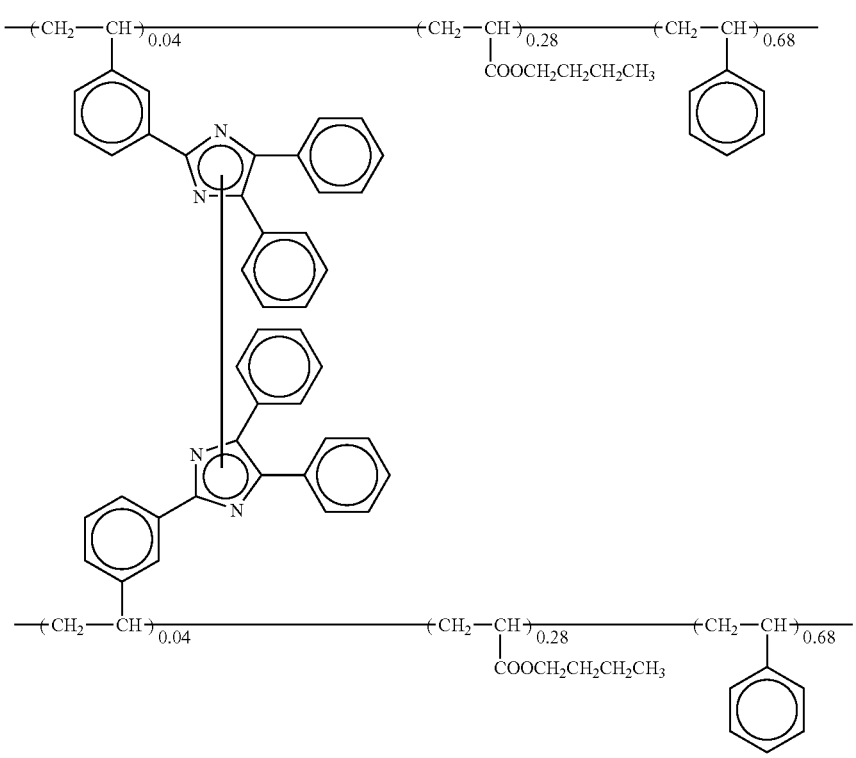

[Synthesis Example of Vinyl-Triphenyl Imidazole Compound 2]

| | |
|---|---|
| Liquid mixture of | 3,090 parts by weight |
| 2-(p-Aminophenyl)4,5-diphenyl imidazole | |
| Methacrylic acid chloride | 925 parts by weight |

was charged in a reaction vessel, and stirring was continued for 1.5 hours at 10° C. After completion of the reaction, the product was diluted with 0.1 N aqueous solution of sodium chloride, and the obtained solid was filtered and washed with water repeatedly, and dried. Then it was purified via silica gel chromatography employing a mixture solvent of hexane/ethylacetate (weight ratio of 9/1) and was recrystallized in a mixture solvent of methanol/dichloroethane (weight ratio of 9/1) to obtain vinyl-triphenyl imidazole compound (2), a compound represented by Formula (b).

Toner Manufacturing Example 2

Toner 2 was obtained by the same manner as Toner Manufacturing Example 1, except that 10 parts by weight of vinyl-iriphenyl imidazole compound (2) was used in place of 10 parts by weight of vinyl-triphenyl imidazole compound (1).

Volume base median particle diameter of Toner (2) was 7.0 μm. Cross-linked polymer (2) was detected from Toner (2). The glass transition point was 55.9° C., and peak molecular weight measured via GPC was 14,400 in Toner (2).

Cross-linked polymer (2)

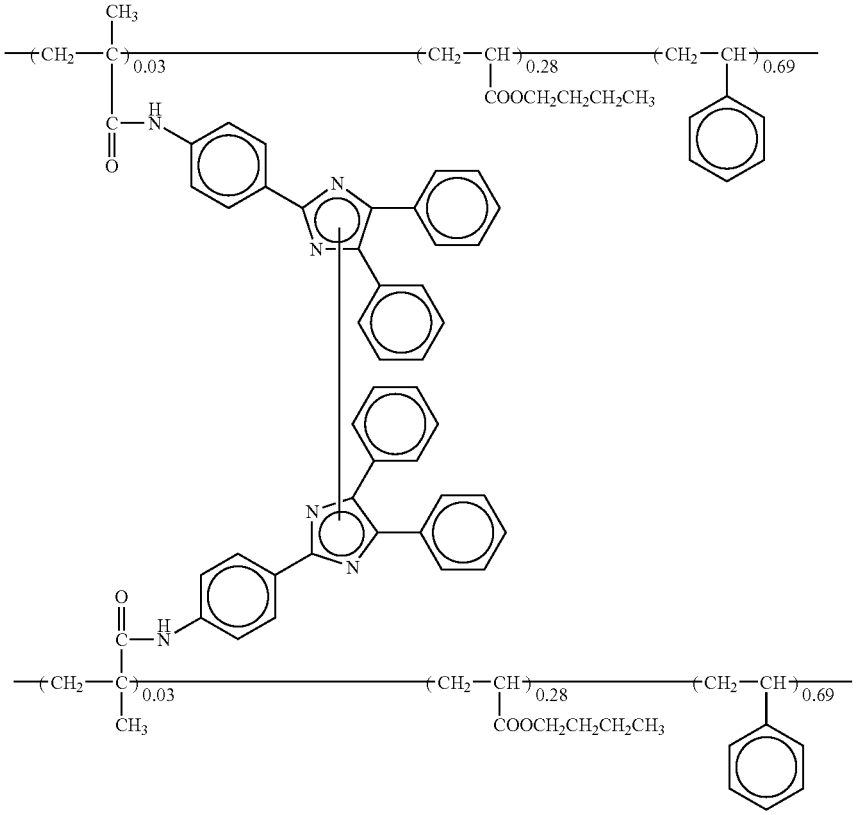

[Synthesis Example of Vinyl-Triphenyl Imidazole Compound 3]

Vinyl-triphenyl imidazole compound (3), a compound represented by Formula (c), was obtained by the same manner as Synthesis example of vinyl-triphenyl imidazole compound 2 except that 3,100 parts by weight of 2-(p-hydroxyphenyl)4,5-diphenyl imidazole was used in place of 3,090 parts by weight of 2-(p-aminophenyl)4,5-diphenyl imidazole.

Toner Manufacturing Example 3

Toner 3 was obtained by the same manner as Toner Manufacturing Example 1, except that 10 parts by weight of vinyl-triphenyl imidazole compound (3) was used in place of 10 parts by weight of vinyl-triphenyl imidazole compound (1).

Volume base median particle diameter of Toner (3) was 6.8 μm. Cross-linked polymer (3) was detected from Toner (3). The glass transition point was 56.6° C., and peak molecular weight measured via GPC was 13,200 in Toner (3).

Cross-linked polymer (3)

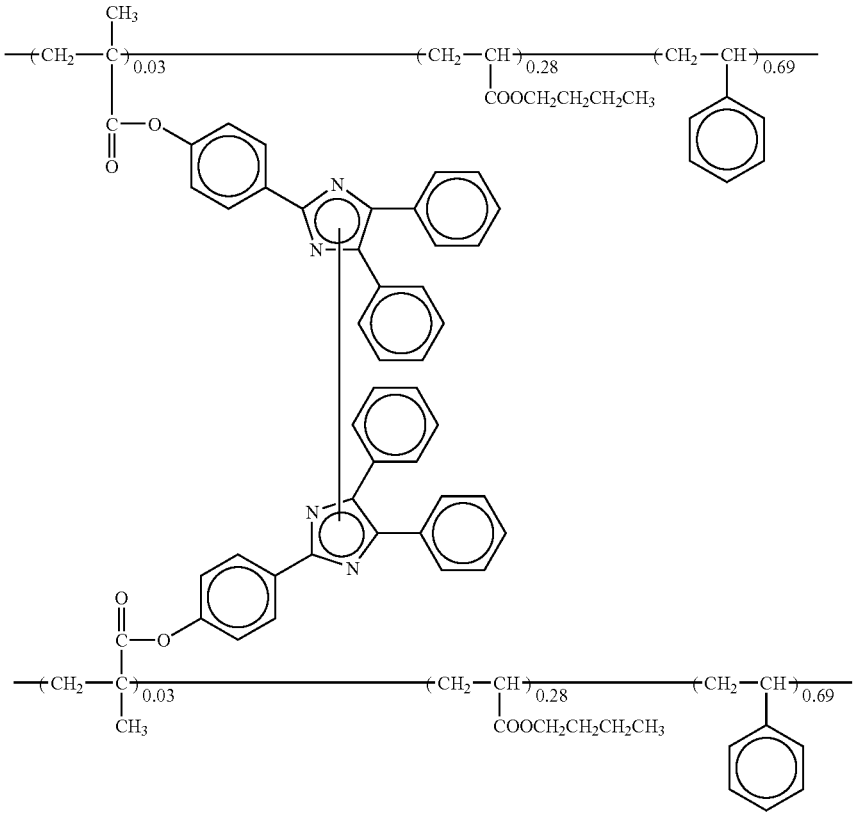

[Synthesis Example of Vinyl-Triphenyl Imidazole Compound 4]

Vinyl-triphenyl imidazole compound (4), a compound represented by Formula (d), was obtained by the same manner as Synthesis example of vinyl-triphenyl imidazole compound 2 except that 710 parts by weight of vinyl isocyanate was used in place of 925 parts by weight of methacrylic acid chloride.

Toner Manufacturing Example 4

Toner 4 was obtained by the same manner as Toner Manufacturing Example 1, except that 10 parts by weight of vinyl-triphenyl imidazole compound (4) was used in place of 10 parts by weight of vinyl-triphenyl imidazole compound (1).

Volume base median particle diameter of Toner (4) was 6.9 μm. Cross-linked polymer (4) was detected from Toner (4). The glass transition point was 55.9° C., and peak molecular weight measured via GPC was 13,000 in Toner (4).

Cross-linked polymer (4)

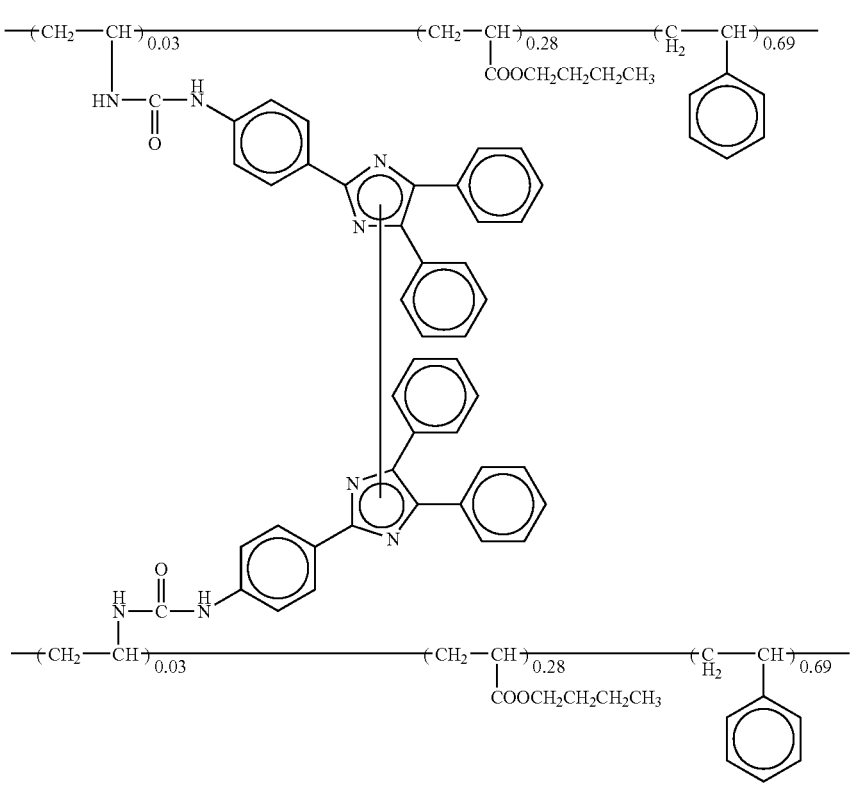

[Synthesis Example of Vinyl-Triphenyl Imidazole Compound 5]

Vinyl-triphenyl imidazole compound (5), a compound represented by Formula (e) was obtained by the same manner as Synthesis example of vinyl-triphenyl imidazole compound 2 except that 3,100 parts by weight of 2-(p-hydroxyphenyl)4,5-diphenyl imidazole and 710 parts by weight of vinyl isocyanate were used in place of 3,090 parts by weight of 2-(p-aminophenyl)4,5-diphenyl imidazole and 925 parts by weight of methacrylic acid chloride.

Toner Manufacturing Example 5

Toner 5 was obtained by the same manner as Toner Manufacturing Example 1, except that 10 parts by weight of vinyl-triphenyl imidazole compound (5) was used in place of 10 parts by weight of vinyl-triphenyl imidazole compound (1).

Volume base median particle diameter of Toner (5) was 6.8 μm. Cross-linked polymer (5) was detected from Toner (5). The glass transition point was 48.2° C., and peak molecular weight measured via GPC was 13,000 in Toner 5.

On the other side, calcium tertiary phosphate in an amount of 2.3 parts by weight was added to 900 parts by weight of ion-exchanged water heated at 60° C., stirred at 10,000 rpm via TK type homomixer (manufactured by Tokushu Kika Kogyo Co., Ltd.) to prepare an aqueous medium. The following compounds

| | |
|---|---|
| Vinyl-triphenyl imidazole dimer compound (6) | 10 parts by weight |
| n-Butyl acrylate | 30 parts by weight |
| Styrene | 40 parts by weight |
| Magenta colorant (C.I. Pigment Red 122) | 10 parts by weight |

were uniformly dispersed and mixed via an attritor mill (manufactured by Mitsui Miike Kakoki Co., Ltd.) and heated up to 60° C., 14 parts by weight of ester wax composing mainly behenyl behenate having maximum endothermic peak of 72° C., measured by DSC was added thereto and dissolved by mixing. Polymerizable monomer composition Cross-linked polymer (5)

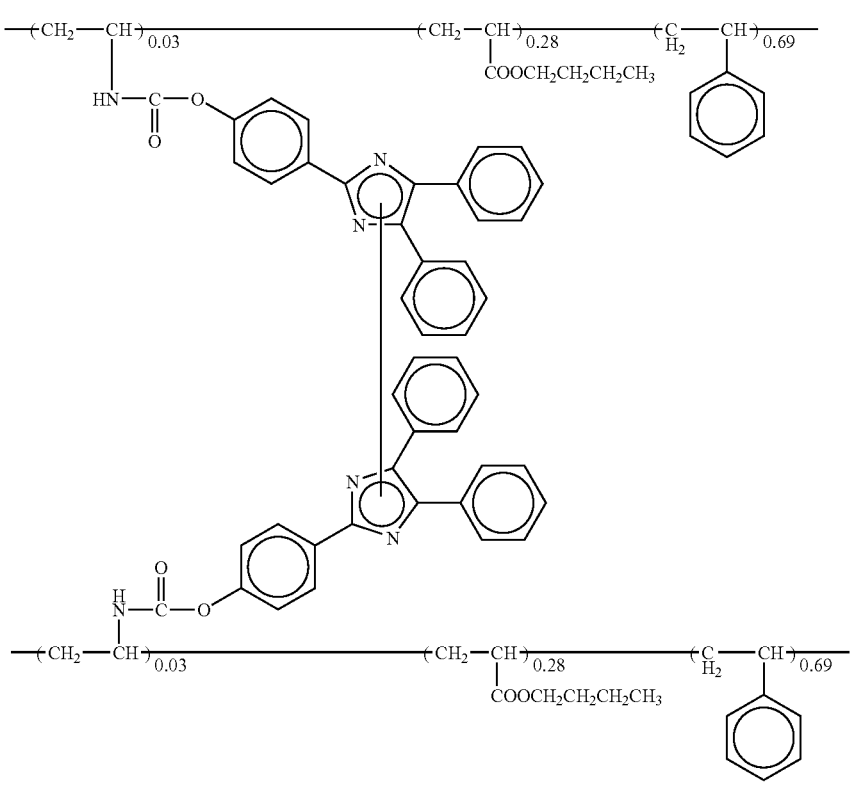

Toner Manufacturing Example 6

| | |
|---|---|
| To liquid composition of Vinyl-triphenyl imidazole compound (1) | 617 parts by weight |
| Ethanol | 80 parts by weight |
| Tetrahydrofuran | 100 parts by weight |

340 parts by weight of 1% potassium ferricyanide aqueous solution was added, and they were subjected to polymerization for 2 hours at 10° C. After that solvent (ethanol and tetrahydrofuran) was removed by distillation, and vinyl-triphenyl imidazole dimer compound (6) that is a dimer of the Vinyl-triphenyl imidazole compound (1).

was prepared by dissolving 4 parts by weight of polymerization initiator lauroyl peroxide having 10 hour half-life temperature of 62° C. therein.

The polymerizable monomer composition was charged into the aqueous medium, and was agitated by TK type homomixer for 7 minutes at 10,000 rpm under nitrogen environment at 60° C., whereby particles were manufactured. Then reaction was continued for 6 hours at 60° C. while stirring by paddle stirring blade, then temperature was raised to 80° C., stirring was continued for 4 hours and suspension liquid was obtained. The suspension liquid was cooled down to room temperature (25° C.), calcium phosphate was dissolved by adding hydrochloric acid, then they were filtered, washed, and dried at 40° C. for 12 hours, and particle diameter was adjusted by air classification to obtain Toner Mother Particle (6).

Hundred parts by weight of the Toner Mother Particle (6), 0.7 parts by weight of hydrophobic silica microparticles having BET value of 200 $m^2/g$ and primary particle diameter of 12 nm, and 0.05 parts by weight ruffle type titanium oxide having primary particle diameter of 250 nm were mixed by Henschel mixer manufactured by Mitsui Miike Kakoki Co., Ltd., and the Toner (6) was obtained. Volume base median particle diameter of Toner (6) was 6.9 μm. Cross-linked polymer (6) was detected from Toner (6). The toner (1) had glass transition point of 54.1° C., and peak molecular weight measured via GPC of 15,200 in Toner (6).

-continued

| | |
|---|---|
| Acrylic acid | 6 parts by weight |
| Tert-dodecylmercaptan | 24 parts by weight. |

The obtained solution was added to an aqueous medium in a flask which is prepared by dissolving 6 parts by weight of polyoxyethylene lauryl ether (E-700, manufactured by Nihon Emulsion Co., Ltd., nonionic surfactant) and 0 parts by weight of sodium n-dodecylbenzene sulfonate in 550 parts by weight of ion-exchanged water, and dispersed. Fifty parts by weight of ion-exchanged water dissolving therein 4 parts by weight of potassium persulfate was added for 10 minutes with slowly stiffing, and nitrogen substitution was conducted.

Cross-linked polymer (9)

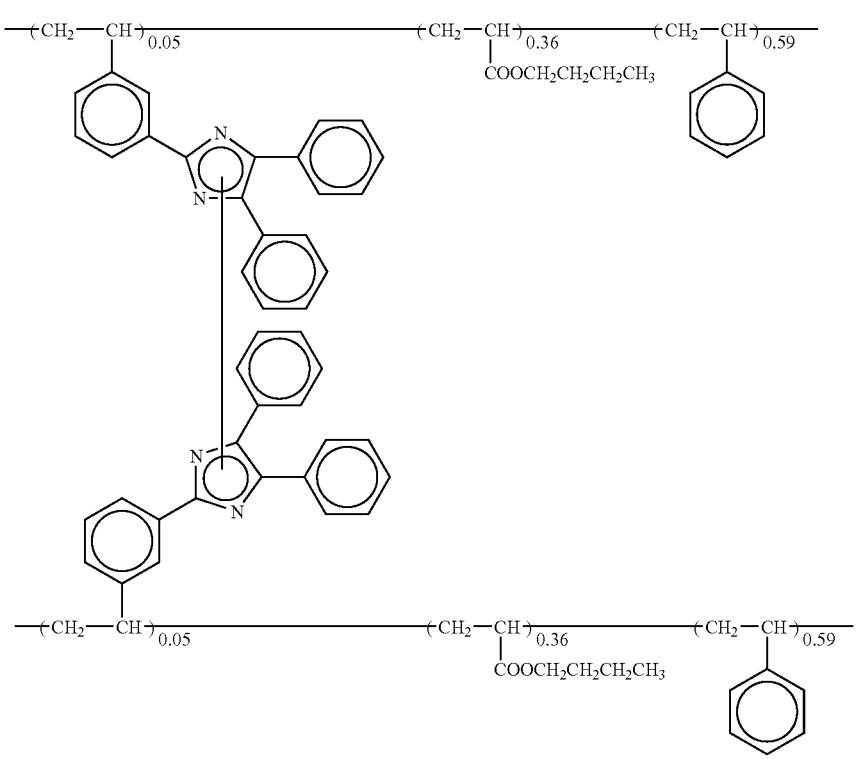

Comparative Toner Manufacturing Example 1

Comparative Toner (x) was obtained by the same manner as Toner Manufacturing Example 1, except that 10 parts by weight of vinyl-triphenyl imidazole compound (1) was not used and the amount of styrene was increased to 70 parts by weight from 60 parts by weight.

Volume base median particle diameter of Toner (x) was 6.9 μm. The glass transition point was 46° C., and peak molecular weight measured via GPC was 11,000.

Toner Manufacturing Example 7

(1) Process of Manufacturing Dispersion of Resin Microparticles

The following compounds were mixed and dissolved;

| | |
|---|---|
| Vinyl-triphenyl imidazole compound (1) | 70 parts by weight |
| Styrene | 240 parts by weight |
| Butyl acrylate | 60 parts by weight |

Then content within the flask was heated up to 70° C. by means of an oil bath with stirring, and emulsion polymerization was continued for 5 minutes to obtain emulsion liquid. The emulsion liquid was cooled down to 10° C. at a rate of −5° C./min, 5 parts by weight of 1% potassium ferricyanide aqueous solution was added, and then they were subjected to reaction for 6 hours at 10° C. Thus Resin microparticles dispersion (1) dispersing Resin microparticles (1) was obtained.

Volume base median particle diameter of Resin microparticles (1) was 155 nm Resin microparticles (1) had a glass transition point of 58° C., and peak molecular weight measured via GPC of 20,000.

(2) Process of Manufacturing Dispersion of Colorant Microparticles

Six parts by weight of nonionic surfactant E-700, manufactured by Nihon Emulsion Co., Ltd., was dissolved in 200 parts by weight of ion-exchanged water with stirring, 50 parts by weight of carbon black REGAL 99R, manufactured by Cabot Corp. as a colorant was gradually while stirring was continued, then was subjected to dispersion treatment via a homogenizer Ultratarax T50, manufactured by IKA Werke GmbH & Co. KG, for 10 minutes, and dispersion of colorant microparticles, in which colorant microparticles were dispersed, was prepared. Particle diameter of the colorant microparticles in the dispersion of colorant microparticles was measured via a cataphoresis light scattering photometer ELS-800, manufactured by Otsuka Electronics Co., Ltd. to find volume base median diameter of 220 nm.

(3) Process of Manufacturing Dispersion of Releasing Agent Microparticles

Five parts by weight of cationic surfactant dodecyl trimethyl ammonium chloride was dissolved in 200 parts by weight of ion-exchanged water with stirring, 50 parts by weight of paraffin wax HNP-0190, manufactured by Nippon Seiro Co., Ltd. as a releasing agent was gradually while stirring was continued, heated up to 95° C., then was subjected to dispersion treatment via a homogenizer Ultratarax T50, manufactured by IKA Werke GmbH & Co. KG, for 10 minutes, and dispersion of releasing agent microparticles, in which releasing agent microparticles were dispersed, was prepared. Particle diameter of the releasing agent microparticles in the dispersion of releasing agent microparticles was measured via a cataphoresis light scattering photometer ELS-800, manufactured by Otsuka Electronics Co., Ltd. to find volume base median diameter of 550 nm.

(4) Process of Coagulation

In a round flask made of stainless steal, the followings were mixed and dispersed via a homogenizer Ultratarax T50, manufactured by IKA Werke GmbH & Co. KG, then heated up to 48° C. with stirring, and kept standing for 48° C. by employing an oil bath.

| | |
|---|---|
| Resin microparticles dispersion (1) | 200 parts by weight |
| Dispersion of colorant microparticles | 30 parts by weight |
| Dispersion of releasing agent microparticles | 40 parts by weight |
| Cationic surfactant (dodecyl trimethyl ammonium chloride) | 1.5 parts by weight |

Further after adding 3 parts by weight of sodium n-dodecylbenzene sulfonate, the flask was sealed and temperature was raised up to 97° C. continuing stirring, and allowed to stand for 3 hours. After cooling, reaction product in the dispersion liquid was filtrated, washed sufficiently with ion-exchange water, and dried to obtain black toner mother particle (7).

Hundred parts by weight of the Toner Mother Particle (7), 0.7 parts by weight of hydrophobic silica microparticles having BET value of 200 $m^2/g$ and primary particle diameter of 12 nm, and 0.05 parts by weight rutile type titanium oxide having primary particle diameter of 250 nm were mixed by Henschel mixer manufactured by Mitsui Miike Kakoki Co., Ltd., and the Toner (7) was obtained. Volume base median particle diameter of Toner (7) was 6.1 μm. Cross-linked polymer (7) was detected from Toner (7). The Toner (7) had glass transition point of 58.4° C., and peak molecular weight measured via GPC of 20,000.

Cross-linked polymer (7)

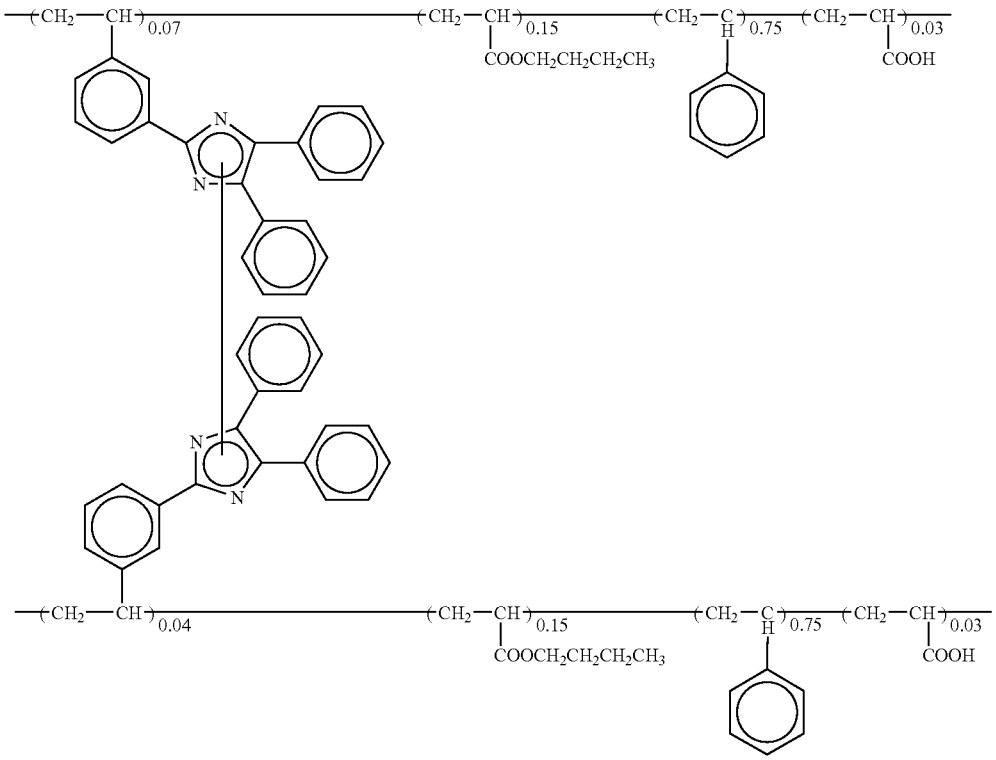

Toner Manufacturing Example 8

Dispersion of Resin microparticles (2) was prepared in the same way as Toner Manufacturing Example 7 except that 35 parts by weight of vinyl-triphenyl imidazole dimer compound (6) was used in replace of 70 parts by weight of vinyl-triphenyl imidazole compound (1)

Volume base median particle diameter of Resin microparticles (2) was 170 nm. Resin microparticles (2) has a glass transition point of 57.2° C., and peak molecular weight measured via GPC of 20,000.

Toner (8) was prepared in the same way as Toner Manufacturing Example 7 except that dispersion of resin microparticles (2) was employed in place of dispersion of resin microparticles (1) in the coagulation process of Toner manufacturing example 7.

Volume base median particle diameter of Toner (8) was 6.3 μm. Cross-linked polymer (8) was detected from Toner (8). The glass transition point was 57.2° C., and peak molecular weight measured via GPC was 20,000 in Toner (8).

(2) Preparation Process of Dispersion of Resin Microparticles for Core Particles Dispersion of resin microparticles (4) was prepared in the same way as preparation process of dispersion of resin microparticles in toner manufacturing example 7, except that 70 parts by weight of vinyl-triphenyl imidazole compound was not employed and amount of butylacrylate was changed to 130 parts by weight from 60 parts by weight. The resin microparticles (4) had volume base median particle diameter of 152 nm, a glass transition point of 21° C., peak molecular weight measured via GPC of 19,200.

(3) Process of Coagulation

In a round flask made of stainless steal, the followings were mixed and dispersed via a homogenizer Ultratarax T50, manufactured by IKA Werke GmbH & Co. KG, then heated up to 48° C. with stirring, and kept standing for 48° C. by employing an oil bath.

Cross-linked polymer (8)

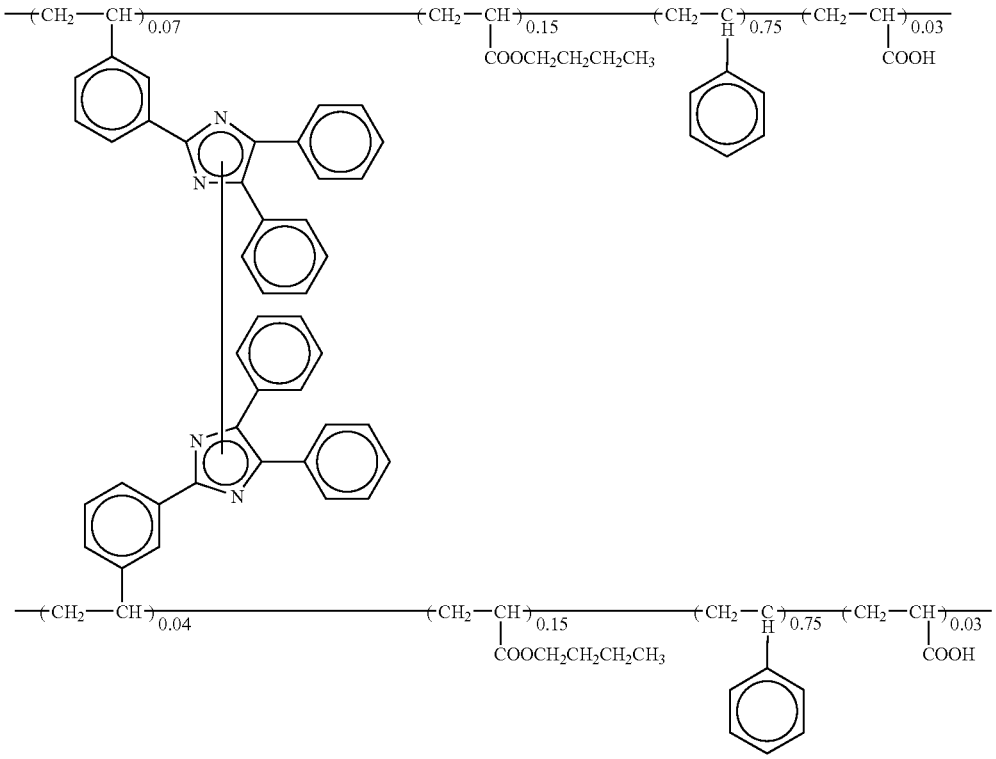

Toner Manufacturing Example 9

(1) Preparation Process of Dispersion of Resin Microparticles for Shell Layer

Dispersion of resin microparticles (3) was prepared in the same way as preparation process of dispersion of resin microparticles in the toner manufacturing example 7, except that 70 parts by weight vinyl-triphenyl imidazole compound (2) was employed in place of 70 parts by weight of vinyl-triphenyl imidazole compound. The resin microparticles (3) had volume base median particle diameter of 148 nm, a glass transition point of 58° C., peak molecular weight measured via GPC of 19,800.

| | |
|---|---|
| Resin microparticles dispersion (4) | 200 parts by weight |
| Dispersion of colorant microparticles | 30 parts by weight |
| Dispersion of releasing agent microparticles | 40 parts by weight |
| Cationic surfactant (dodecyl trimethyl ammonium chloride) | 1.5 parts by weight |

Then dispersion of resin microparticles (3) was added in the solid conversion amount of 60 parts by weight for shell forming material, and temperature was maintained at 48° C. for 30 minutes.

Further after adding 3 parts by weight of sodium n-dodecylbenzene sulfonate, the flask was sealed and temperature was raised up to 97° C. continuing stirring, and allowed to stand for 3 hours. After cooling, reaction product in the dispersion liquid was filtrated, washed sufficiently with ion-exchange water, and dried to obtain black Toner Mother Particle (9).

Hundred parts by weight of the Toner Mother Particle (9), 0.7 parts by weight of hydrophobic silica microparticles having BET value of 200 $m^2/g$ and primary particle diameter of 12 nm, and 0.05 parts by weight ruffle type titanium oxide having primary particle diameter of 250 nm were mixed by Henschel mixer manufactured by Mitsui Miike Kakoki Co., Ltd., and the Toner (9) was obtained. Volume base median particle diameter of Toner (9) was 6.4 μm. Cross-linked polymer (9) was detected from Toner (9). The Toner (9) had glass transition point of 31° C., and peak molecular weight measured via GPC of 19,200.

speed of the stirring blade of 8 m/sec, at 30° C., then heated up to 120° C., and stirring was continued for 4 hours. Fragments of the methylmethacrylate-cyclohexylmethaciylate copolymer were removed by means of 200 mesh sieve after cooling, and resin coated carrier was prepared.

Two-component developer (1) to (9) and comparative two component developers (x) and (y) were prepared by mixing the resin coated carrier with the Toners (1) to (9) and comparatives (x) and (y), respectively, so as to have toner density of 7% by weight.

Examples 1 to 9 and Comparative Examples 1 and 2

Two-component developer (1) to (9) and comparative two component developers (x) and (y) were tested in the following evaluation items (1) to (3).

Cross-linked polymer (9)

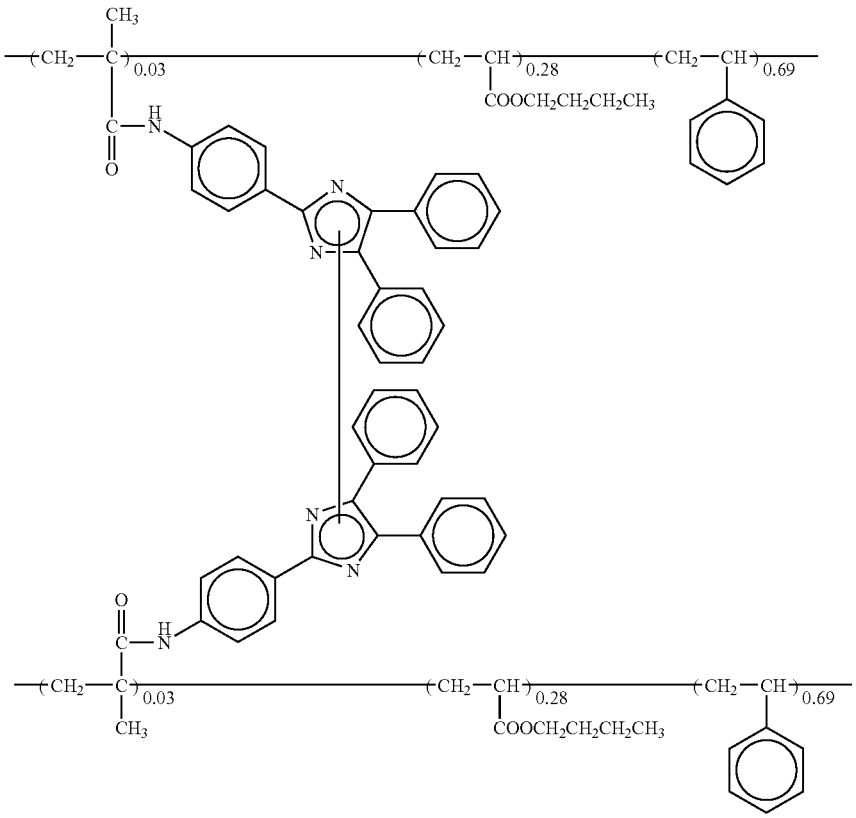

Comparative Toner Manufacturing Example 2

Comparative Toner (y) was obtained by the same manner as Toner Manufacturing Example 7, except that the same amount of Resin microparticles dispersion (4) was used in place of Resin microparticles dispersion (1) in the process of coagulation.

Volume base median particle diameter of Toner (x) was 6.5 μm. The glass transition point was 49.8° C., and peak molecular weight measured via GPC was 10,000 in Toner (y).

Preparation of Two-Component Developer

Hundred parts by weight of ferrite particles having volume base median particle diameter of 50 μm manufactured by Powdertech Co., Ltd. and 4 parts by weight of methylmethacrylate-cyclohexylmethacrylate copolymer having volume base median particle diameter of 85 nm were put into a horizontal stirring blade type high speed stirring apparatus, and mixed for 15 minutes under a condition of peripheral (1) Low Temperature Fixing Ability Fixing process of the toner image was conducted by employing a digital printer "bizhub 920" produced by Konica Minolta Business Technologies, Inc. on the market which was modified so that the fixing surface temperature of the heating member changes at each of interval temperatures of 5° C. ranging from 80 to 150° C. At each temperature, toner image was fixed on 350 g weight paper measured at 20° C. and 50% RH as an image carrying support, and thus printed matters were obtained. Fixing strength of the printed matters at an image portion was measured by a mending tape peeling method described below, and temperature of the fixing heating member giving fixing strength of 90% or more was evaluated as fixing capable temperature. Fixing capable temperature of 110° C. or less was ranked acceptable.

Mending Tape Peeling Method

1) Absolute reflective image density $D_0$ of the printed matter having image density of 1.3 at the image portion was measured, and then the printed material was fold doubly at the image portion.

2) Mending tape No. 810-3-12 manufactured by Sumitomo 3M Limited was lightly pasted on the image portion doubly folded.

3) Pasted mending tape was rubbed at a pressure of 1 kPa four times.

4) Mending tape was removed at an angle of 180° with 2N force.

5) Absolute reflective image density $D_1$ at the image portion of the printed matter after peeling.

6) Fixing strength was calculated by the following Formula (D).

Formula (D)

$$\text{Fixing strength (\%)}=D_1/D_0\times 100$$

The absolute reflective image density was measured by a reflective densitometer RD-918 manufactured by Gretag Macbeth: GMB.

(2) Storage Durability Against Heat

In an aggregation rate test, 0.5 g of a toner sample is placed in a 10 ml glass bottle having a 21 mm inner diameter, and the lid is closed. The covered bottle is shaken 600 times using tap denser KYT-2000 (produced by Seishin Enterprise Co., Ltd.), followed by being allowed to stand, in the state of being uncovered, under an ambience of 55° C. and 35% RH for two hours. Subsequently, the toner sample is placed onto a 48 mesh (open area: 350 μm) sieve with enough care so that the toner aggregate is not pulverized, and then set in a powder tester (produced by Hosokawa Micron Corp.), followed by being fixed with a presser bar and a knob nut to set shaking intensity at a sliding width of 1 mm. The rate (weight %) of the amount of the residual toner on the sieve is measured after 10 seconds of shaking.

Then, the toner aggregation ratio is calculated by the following formula:

$$\text{Toner aggregation ratio (\%)}=(\text{weight (g) of the residual toner on a sieve})/0.5\ \text{(g)}\times 100$$

Criteria:

Toner aggregation ratio of less than 15%: Excellent

Toner aggregation ratio of not less than 15% to not more than 20%: Good

Toner aggregation ratio of more than 20%: Practically not acceptable (3) Toner Particle Strength Two component developer was set in a digital printer "bizhub 920" produced by Konica Minolta Business Technologies, Inc. on the market, stirring test was conducted in such way that toner was stirred for two hours under the potential condition not to form a latent image on a photoreceptor, that is, toner is not developed. Then the toner was took out, and was subjected to measuring toner particle diameter distribution, number of particles having particle diameter of not more than 1 μm, and total number of toner particles by employing flow type particle image analyzer FPIA produced by Sysmex Corp. The particle strength index represented by the following formula (M) was calculated and the particle strength was evaluated.

Formula (M)

$$\text{Particle strength index}=(\text{Number of toner particles having particle diameter of not more than 1 μm})/(\text{Total number of toner particles})\times 100$$

Particle strength index of each two-component developer before the stirring test was not less than 1. When the particle strength index after the stirring test is 9 or less, the toner particles have sufficient particle strength so that powder crashing does not occurs, generation of carrier stain is suppressed and sufficient anti-stress property is obtained. Consequently, it is considered that the longer cycle time for replenishing two-component developer can be obtained. On the other side, when the particle strength index after the stirring test is more than 9, it is observed by electron microscope that surface of the carrier particles are dominantly covered with crashed fragment of toner particles, opportunity of frictional electrification of the carrier particles and toner particles reduces overwhelmingly. Consequently, it is considered that toner scattering from the developing device becomes too remarkable to be acceptable for practical use.

TABLE 1

| | Toner No. | Low temperature fixing ability (° C.) | Storage durability against heat (%) | Particle strength |
|---|---|---|---|---|
| Example 1 | 1 | 90 | 5.1 | 2.3 |
| Example 2 | 2 | 95 | 6.7 | 5.8 |
| Example 3 | 3 | 95 | 8.8 | 6.2 |
| Example 4 | 4 | 95 | 7.1 | 5.4 |
| Example 5 | 5 | 95 | 6.8 | 7.4 |
| Example 6 | 6 | 95 | 6.8 | 8.0 |
| Example 7 | 7 | 90 | 5.5 | 2.6 |
| Example 8 | 8 | 90 | 5.4 | 2.2 |
| Example 9 | 9 | 85 | 4.8 | 7.7 |
| Comparative 1 | x | 120 | 16.2 | 14.3 |
| Comparative 2 | y | 120 | 18.2 | 17.5 |

The invention claimed is:

1. A toner for an electrophotography which comprises toner particles containing a cross-linked polymer having two-valent crosslinking group represented by Formula (1), Formula (1)

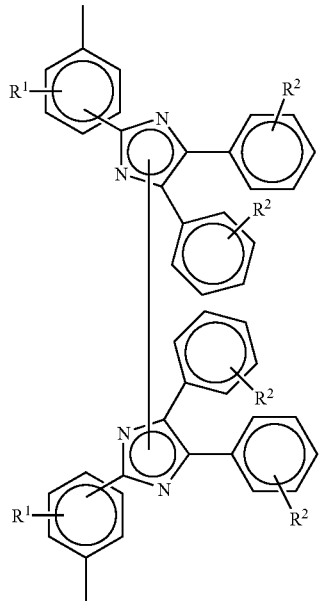

wherein, $R^1$ is a hydrogen atom or a chlorine atom, $R^2$ is a hydrogen atom, a chlorine atom or a methoxy group.

2. The toner of claim 1, wherein the cross-linked polymer has a structural unit represented by Formula (2), Formula (2)

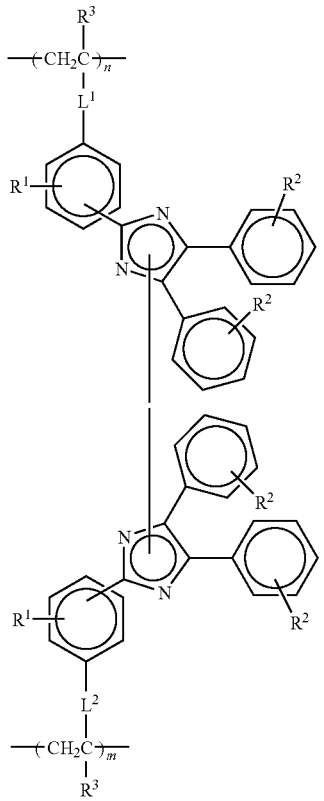

wherein, $R^1$ is a hydrogen atom or a chlorine atom, $R^2$ is a hydrogen atom, a chlorine atom or a methoxy group, $R^3$ is a hydrogen atom or a methyl group, $L^1$ and $L^2$ each are a single bond or a divalent organic group, and $L^1$ and $L^2$ may be same or different each other, and m and n are number of recurring units.

3. The toner of claim 2, wherein $L^1$ is a single bond, or an organic group selected from the group consisting of —C(=O)—NH—, —C(=O)O—, —NH(C=O)NH— and —NHC(=O)O—.

4. The toner of claim 3, wherein the core particle contains a charge control agent or magnetic powder.

5. The toner of claim 3, wherein the shell layer contains a colorant or a releasing agent.

6. The toner of claim 1, wherein the toner particles have a core shell structure in which each of the toner particles is composed of a core particle and a shell layer covering the core particle and the shell layer contains the cross-linked polymer.

7. The toner of claim 6, wherein the core particle contains a resin having a glass transition point of 10 to 46° C.

8. A manufacturing method of toner of claim 1, comprising steps of;

preparing a dimer of the polymerizable triaryl imidazole compound represented by Formula (4) by bonding between imidazole rings of the triaryl imidazole groups of the polymerizable triaryl imidazole compound represented by Formula (3), and then, preparing the cross-linked polymer by conducting polymerization processing the dimer of the polymerizable triaryl imidazole compound, Formula (3)

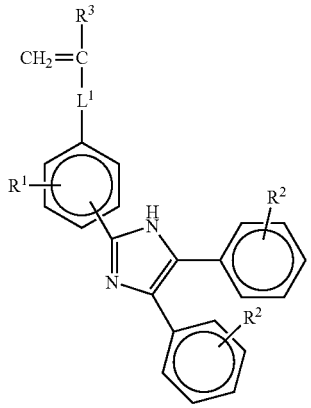

in the Formula (3), $R^1$ is a hydrogen atom or a chlorine atom, $R^2$ is a hydrogen atom, a chlorine atom or a methoxy group, $R^3$ is a hydrogen atom or a methyl group, $L^1$ is a single bond or a two-valent organic group, Formula (4)

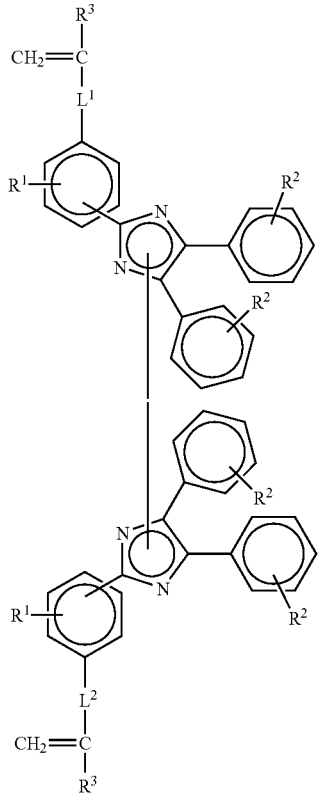

in the Formula (4), $R^1$ is a hydrogen atom or a chlorine atom, $R^2$ is a hydrogen atom, a chlorine atom or a methoxy group, $R^3$ is a hydrogen atom or a methyl group, $L^1$ and $L^2$ are each a single bond or a two-valent organic group, and $L^1$ and $L^2$ may be same or different each other.

9. A manufacturing method of toner of claim 1, comprising steps of, preparing a prepolymer containing a triarylimidazole group having a structural unit represented by Formula (5) by conducting polymerization processing a polymerizable triaryl imidazole compound represented by Formula (3) and then, preparing the cross-linked polymer by bonding between imidazole rings of the triaryl imidazole groups, Formula (3)

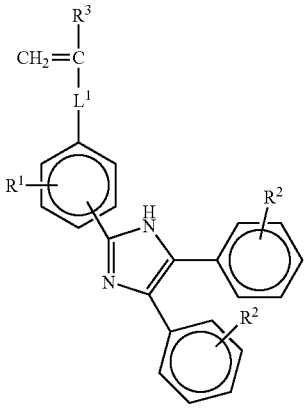

in the Formula (3), $R^1$ is a hydrogen atom or a chlorine atom, $R^2$ is a hydrogen atom, a chlorine atom or a methoxy group, $R^3$ is a hydrogen atom or a methyl group, and $L^1$ is a single bond or a two-valent organic group, Formula (5)

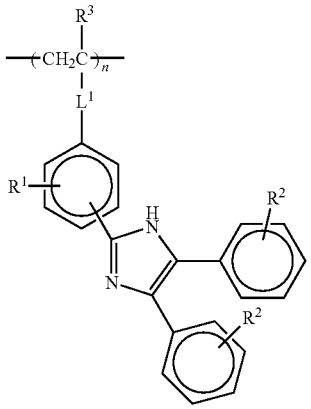

in the Formula (5), $R^1$ is a hydrogen atom or a chlorine atom, $R^2$ is a hydrogen atom, a chlorine atom or a methoxy group, $R^3$ is a hydrogen atom or a methyl group, $L^1$ is a single bond or a two-valent organic group, and n is a number of recurring units.

* * * * *